US009307811B1

(12) United States Patent
Allen

(10) Patent No.: US 9,307,811 B1
(45) Date of Patent: Apr. 12, 2016

(54) STICK AND PICK SYSTEMS

(71) Applicant: Gene Allen, Tyler, TX (US)

(72) Inventor: Gene Allen, Tyler, TX (US)

( * ) Notice: Subject to any disclaimer, the term of this patent is extended or adjusted under 35 U.S.C. 154(b) by 0 days.

(21) Appl. No.: 14/696,468

(22) Filed: Apr. 26, 2015

Related U.S. Application Data

(60) Provisional application No. 61/991,603, filed on May 11, 2014.

(51) Int. Cl.
*A45B 3/00* (2006.01)
*A61H 3/02* (2006.01)

(52) U.S. Cl.
CPC ..... *A45B 3/00* (2013.01); *A61H 2003/0222* (2013.01)

(58) Field of Classification Search
CPC ..... A61H 2003/0222; A45B 3/00
USPC ..... 135/66; 294/100
See application file for complete search history.

(56) References Cited

U.S. PATENT DOCUMENTS 3,146,015 A * 8/1964 Roberge ..... 294/104
4,027,687 A * 6/1977 McGowan ..... 135/66
5,392,800 A * 2/1995 Sergi ..... 135/65
5,636,650 A * 6/1997 Kroeze ..... 135/66
5,640,985 A * 6/1997 Snyder et al. ..... 135/65
6,527,321 B1 3/2003 Kuciauskas
7,243,668 B1 * 7/2007 Kroeze ..... 135/77
7,360,548 B1 4/2008 Hinca
8,381,748 B2 * 2/2013 Martin ..... 135/66
8,714,170 B1 5/2014 Bonne et al.
2009/0032077 A1 * 2/2009 Hines ..... 135/66
2014/0261590 A1 * 9/2014 Riemer ..... A45B 3/04 135/66

FOREIGN PATENT DOCUMENTS

DE 4337298 A1 * 5/1995 ..... A45B 3/00
GB 998788 A * 7/1965 ..... A45B 3/00

* cited by examiner

*Primary Examiner* — Noah Chandler Hawk

(57) ABSTRACT

A walking stick with a trigger mechanism system includes a walking stick with a trigger mechanism assembly including a walking stick having a handle including a trigger mechanism; a shaft having a length and including a grabber able to be manipulated between open and closed positions; a grabber manipulator; and a magnet. The walking stick with a trigger mechanism system includes the walking stick with a trigger mechanism assembly. The walking stick with a trigger mechanism system is structured and arranged to permit a user to retrieve at least one item items from a surface without unduly bending and stretching.

1 Claim, 5 Drawing Sheets

STICK AND PICK SYSTEMS

CROSS-REFERENCE TO RELATED APPLICATION

The present application is related to and claims priority from prior provisional application Ser. No. 61/991,603, filed May 11, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of object grabbing assistive devices and more specifically relates to a walking stick with a trigger mechanism system.

2. Description of the Related Art

As baby-boomers age and the numbers of seniors living longer increases, many consumers need the assistance of walking sticks or canes to provide stability, so they can continue to be get around safely and be active. A walking stick is a device used by many people to facilitate balancing while walking. Walking sticks come in many shapes and sizes, and can be sought by collectors. Some kinds of walking stick may be used by people with disabilities as a crutch. The walking stick has also historically been known to be used as a defensive or offensive weapon, and may conceal a knife or sword as in a swordstick.

Unfortunately, many younger people have the same need if they have suffered injuries playing sports or in accidents or have an illness that necessitates the use of a cane when walking. The same individuals experience additional problems when they must bend over to pick up an object from the floor or stretch to reach something up high. These individuals need a convenient "grabber" to eliminate the risk of losing their balance, falling or injuring themselves. A multi-functional walking stick is desired.

Various attempts have been made to solve the above-mentioned problems such as those found in U.S. Pat. No. 6,527,321 to Alex Kuciauskas; U.S. Pat. No. 7,360,548 to Robert Hinca; and U.S. Pat. No. 8,714,170 to Bonee et al. This art is representative of object grabbing assistive devices. None of the above inventions and patents, taken either singly or in combination, is seen to describe the invention as claimed.

Ideally, a walking stick with a trigger mechanism system should be user-friendly and safe in-use and, yet may operate reliably and be manufactured at a modest expense. Thus, a need exists for a walking stick with a trigger mechanism system that is structured and arranged to permit a user to retrieve at least one item items from a surface without unduly bending and stretching as well as to provide walking stability to the user and to avoid the above mentioned problems.

BRIEF SUMMARY OF THE INVENTION

In view of the foregoing disadvantages inherent in the known object grabbing assistive devices art, the present invention provides a walking stick with a trigger mechanism system (entitled 'Stick and Pick Systems'). The general purpose of the present invention, which will be described subsequently in greater detail is to provide a walking stick with a trigger mechanism system that is structured and arranged to permit a user to retrieve at least one item items from a surface without unduly bending and stretching.

A walking stick with a trigger mechanism system is disclosed herein comprising: a walking stick with a trigger mechanism assembly including a walking stick having a handle including a trigger mechanism; a shaft having a length and including a grabber able to be manipulated between open and closed positions; a grabber manipulator; and a magnet. The walking stick with a trigger mechanism system comprises the walking stick with a trigger mechanism assembly.

The walking stick with a trigger mechanism assembly preferably comprises heavy-duty plastic to provide durability and strength when grasping the at least one object while yet being corrosion-resistant. The handle, the shaft, and the magnet comprise the walking stick for use. The handle provides a region for a hand of a user to grasp the walking stick thereby. The interior of the handle is hollow.

The trigger mechanism is activatable by manipulating the trigger relative toward the handle and pulling on the grabber manipulator. The trigger mechanism is squeezable. The trigger mechanism comprises a lever. The trigger mechanism preferably comprises a plurality of indented-contours to match alignment with the hand of the user so it is comfortable regardless the use it is being applied for. The indented-contours comprise digit-engageable notches for wrapping at least one digit around the trigger mechanism prior to activating the trigger mechanism. When the trigger mechanism is activated, the grabber moves in an outward direction away from the shaft into the open position ready for an in-use condition suitable for picking up at least one item from a surface. The surface comprises a horizontal planar surface such as a floor or the ground.

When the trigger mechanism is in a squeezable position, the grabber is in the open position. When the trigger mechanism is in a non-squeezable position, the grabber is in the closed position. When the trigger mechanism is released, the grabber moves in an inward direction towards the shaft into the closed position.

The grabber comprises a plurality of indents for removably-securing at least one item when grabbed. The plurality of indents comprise teeth. The grabber manipulator comprises a cable. The magnet is structured and arranged at a terminal end of the shaft to retrieve ferrous objects. The magnet further comprises a rubberized stop for preventing unwanted displacement of the walking cane while in the in-use condition for steadying the user while walking and/or standing. The walking stick with a trigger mechanism system is structured and arranged to permit a user to retrieve at least one item from a surface without unduly bending and stretching.

A kit is also embodied herein for the walking stick with a trigger mechanism system comprising: a plurality of walking stick with a trigger mechanism assemblies in various colors, designs, logos, indicias, and shaft lengths to accommodate users of varying heights; and a set of user-instructions.

A method of using a walking stick with a trigger mechanism system is disclosed herein a preferred embodiment comprising the steps of: choosing a walking stick with a trigger mechanism assembly in a user-preferred shaft-length, color, and design; a user grasping a handle of the walking stick with a trigger mechanism assembly; the user using the walking stick to aid in walking; the user locating at least one item on a vertical planar surface to be picked up; the user activating a grabber to an open position by squeezing a trigger mechanism on the handle to grasp at least one item; the grabber grasping the at least one item; the user lifting the walking cane to access the at least one item; the user decompressing (releasing) the trigger mechanism to release the at least one item thereby moving the grabber to a closed position; and the user using the walking stick with a trigger mechanism assembly as the walking cane once again until a final destination is reached.

The present invention holds significant improvements and serves as a walking stick with a trigger mechanism system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention walking stick with a trigger mechanism system (Stick and Pick Systems) constructed and operative according to the teachings of the present invention.

The various embodiments of the present invention will hereinafter be described in conjunction with the appended drawings, wherein like designations denote like elements.

DETAILED DESCRIPTION

Figure 1:
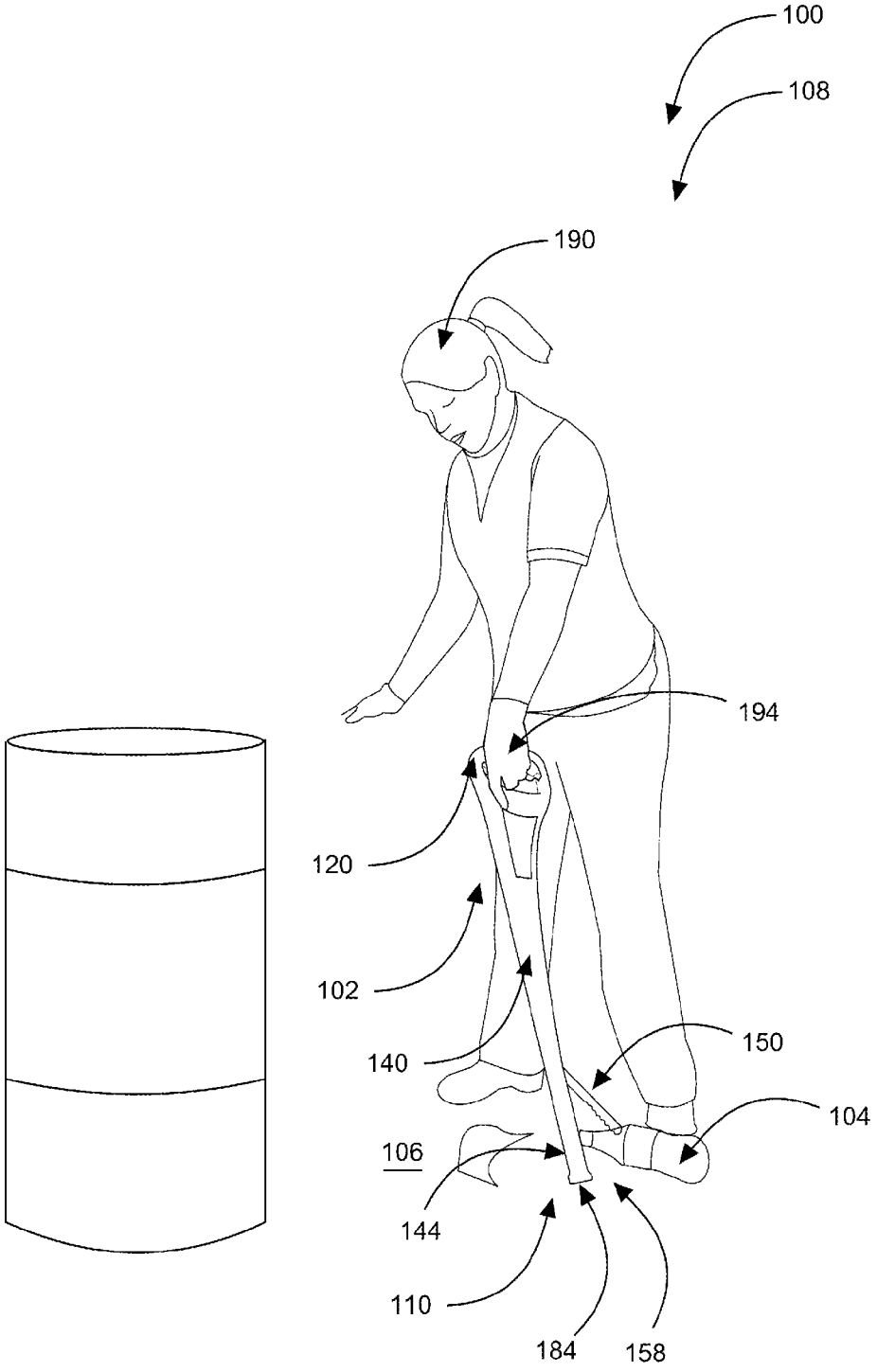
FIG. 1 shows a front perspective view illustrating a walking stick with a trigger mechanism system in an 'in-use' condition according to an embodiment of the present invention.
Figure 2:
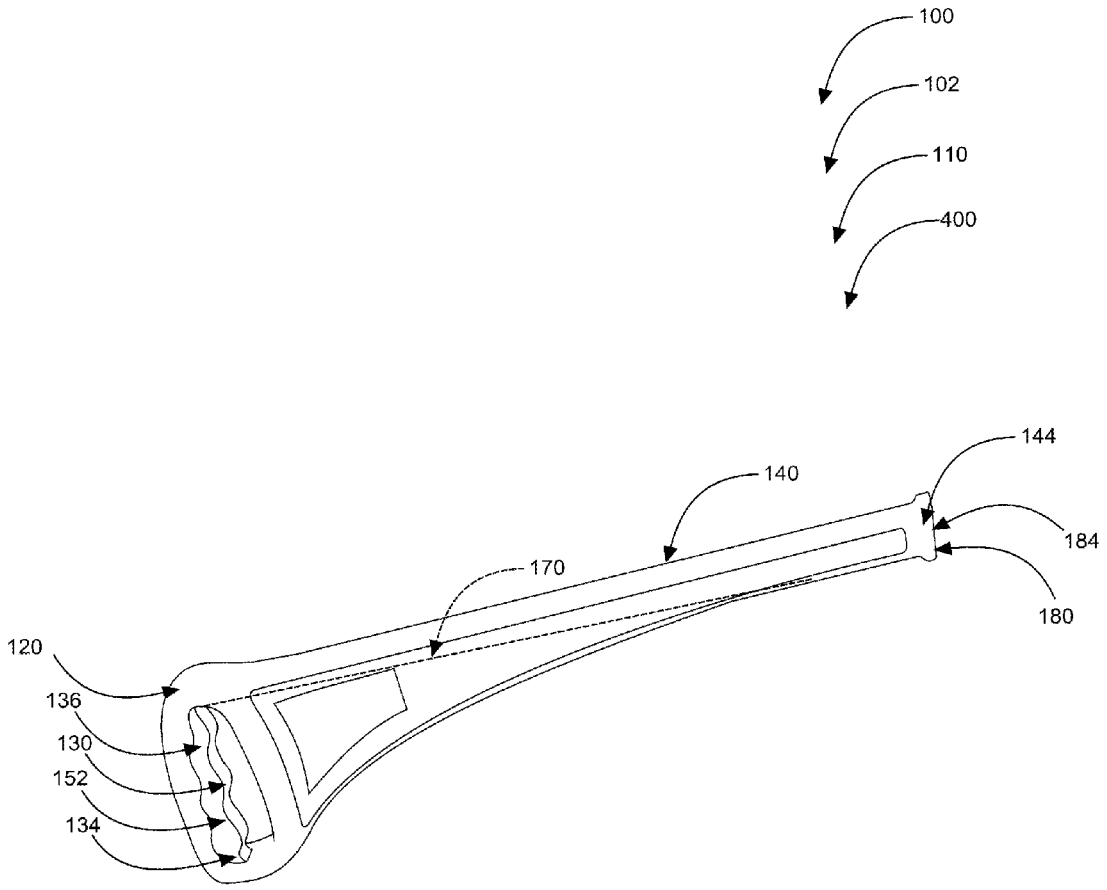
FIG. 2 shows a front perspective view illustrating a walking stick with a trigger mechanism assembly of the walking stick with a trigger mechanism system according to an embodiment of the present invention.
Figure 3:
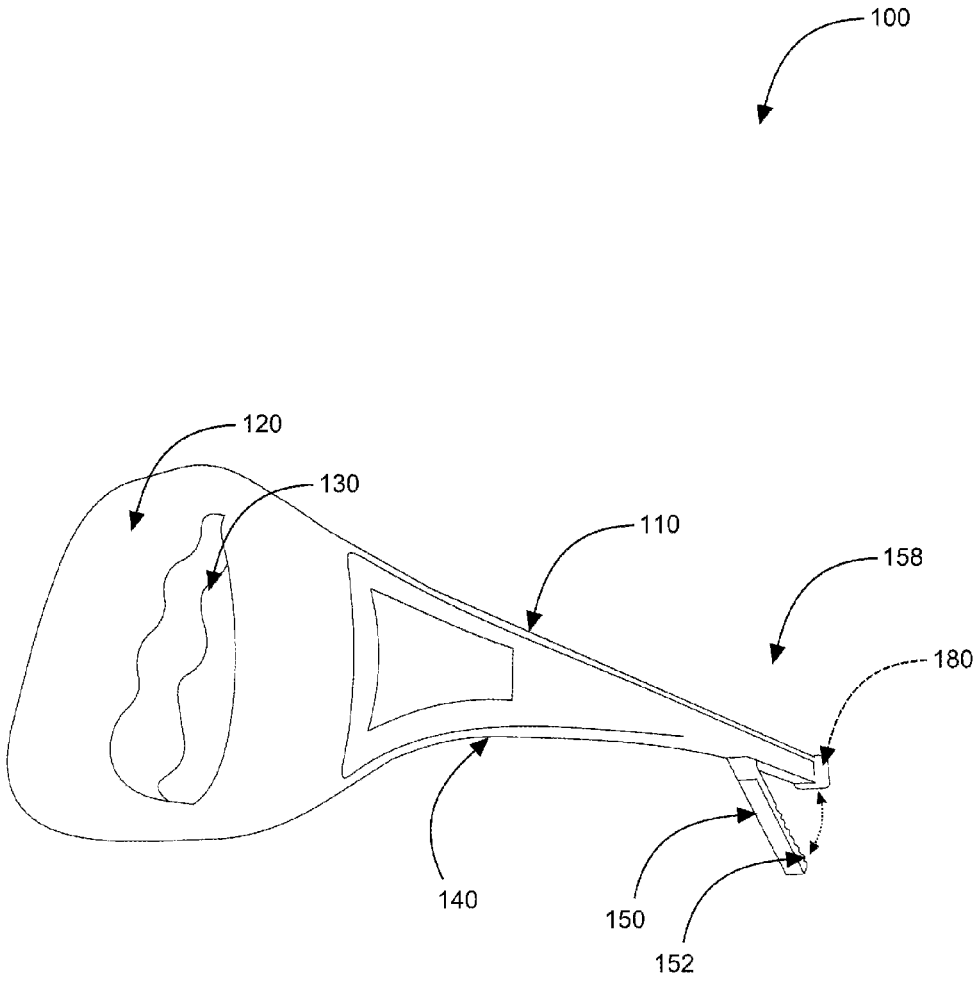
FIG. 3 is a perspective view illustrating the walking stick with a trigger mechanism assembly of the walking stick with a trigger mechanism system according to an embodiment of the present invention.

As discussed above, embodiments of the present invention relate to an object grabbing assistive device and more particularly to a walking stick with a trigger mechanism system (entitled Stick and Pick Systems) that is structured and arranged to permit a user to retrieve at least one item items from a surface without unduly bending and stretching.

Generally speaking, walking stick with a trigger mechanism system comprises a specially designed (multi-purpose) walking stick for the majority of seniors and many others who may need assistance when walking. When a situation occurs that requires the user to retrieve an object that is not within their reach comfortably, they will be able to use the mechanical grabber to grasp it for them. The mechanical grabber is preferably activated by squeezing the bottom of the handle. It pops out from the side of the walking stick, near the bottom, and can be manipulated to grasp the needed object. It will be easier to retrieve small metal objects with the magnet that is attached to the bottom of this walking stick. There are several different versions of this walking stick available, in different lengths and colors, to appeal to consumers. All will preferably have rubberized tips for safety.

The unique features of this invention will preferably provide the following benefits for all consumers using walking sticks: first the present invention will preferably provide a convenient grabber so users will no longer risk pain and injury by bending over or stretching to retrieve needed items. Second, users will preferably feel more independent and confident knowing they can retrieve anything by themselves. Third, the present invention will be within close proximity to the user when needed and is easy to operate. Lastly, a plurality of items may be retrieved with the magnetic end.

Referring now to the drawings by numerals of reference there is shown in FIGS. 1-4B perspective views illustrating walking stick with a trigger mechanism assembly 102 of walking stick with a trigger mechanism system 100 according to an embodiment of the present invention.

Walking stick with a trigger mechanism system 100 comprises: walking stick with a trigger mechanism assembly 102 including walking stick 110 having handle 120 including trigger mechanism 130; shaft 140 having a length and including grabber 150 able to be manipulated between open position 158 and closed position 164; grabber manipulator 170; and magnet 180. Walking stick with a trigger mechanism system 100 comprises walking stick with a trigger mechanism assembly 102. Walking stick with a trigger mechanism system 100 is structured and arranged to permit user 190 to retrieve at least one item 104 from surface 106 without unduly bending and stretching as shown in in-use condition 108 of FIG. 1.

Walking stick with a trigger mechanism assembly 102 preferably comprises heavy-duty plastic to provide durability and strength when grasping at least one item 104 while yet being corrosion-resistant. Upon reading this specification, it should be appreciated that, under appropriate circumstances, considering such issues as user preferences, design preference, structural requirements, marketing preferences, cost, available materials, technological advances, etc., other material arrangements such as, for example, metal, ferrous and non-ferrous materials, composites, etc., may be sufficient. Handle 120, shaft 140, and magnet 180 comprise walking stick 110 for use. Handle 120 provides a region for hand 194 of user 190 to grasp walking stick 110. The interior of handle 120 is hollow.

Trigger mechanism 130 is activated by manipulating trigger 134 relative toward handle 120 and pulling on grabber manipulator 170. Trigger mechanism 130 is squeezable. Trigger mechanism 130 may comprise a lever. Upon reading this specification, it should be appreciated that, under appropriate circumstances, considering such issues as user preferences, design preference, structural requirements, marketing preferences, cost, available materials, technological advances, etc., other trigger mechanism arrangements such as, for example, buttons, clips, etc., may be sufficient.

Trigger mechanism 130 may comprise plurality of indented-contours 136 to match alignment with hand 194 of user 190. Indented-contours 136 preferably comprise digit-engageable notches for wrapping at least one digit around trigger mechanism 130 prior to activating trigger mechanism 130. When trigger mechanism 130 is activated, grabber 150 moves in an outward direction away from shaft 140 into open position 158 ready for in-use condition 108 suitable for picking up at least one item 104 from surface 106. Surface 106 may comprises a horizontal or vertical planar or non-planar surface.

Figure 4A:
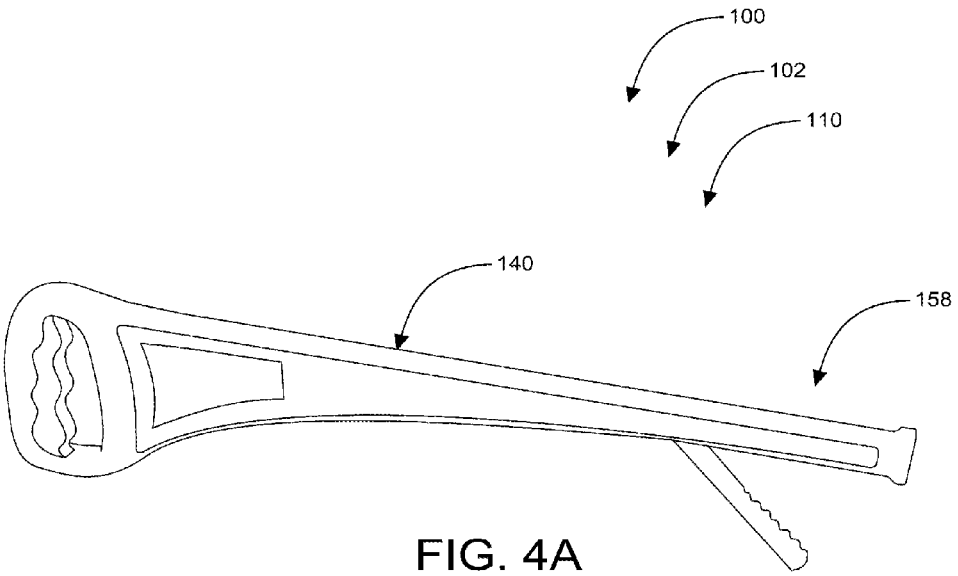
FIG. 4A is a perspective view illustrating a walking stick with a trigger mechanism assembly having the grabber in an open-position of the walking stick with a trigger mechanism system according to an embodiment of the present invention.
Figure 4B:
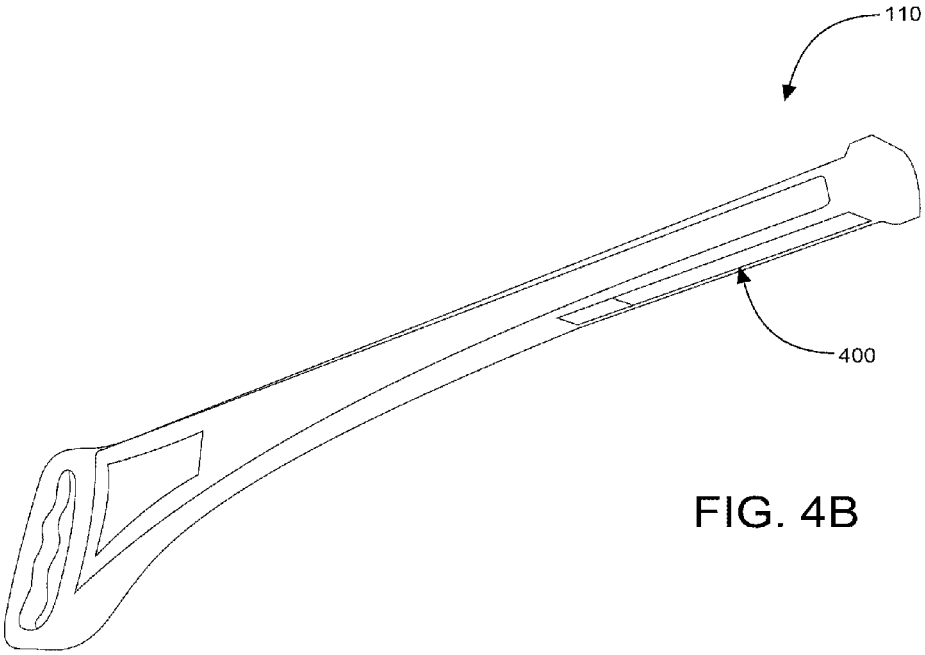
FIG. 4B is a perspective view illustrating a walking stick with a trigger mechanism assembly having the grabber in a closed-position of the walking stick with a trigger mechanism system according to an embodiment of the present invention.

When trigger mechanism 130 is in a squeezable position, grabber 150 is in open position 158. When trigger mechanism 130 is in a non-squeezable position, grabber is in closed position 400 as shown in FIG. 4B. When trigger mechanism 130 is released, grabber 150 moves in an inward direction towards shaft 140 into closed position 164.

Grabber 150 comprises plurality of indents 152 for removably-securing at least one item 104 when grabbed. Plurality of indents 152 preferably comprise teeth. Grabber manipulator 170 preferably comprises a cable; however other grabber manipulators 170 may be suitable used. Magnet 180 is structured and arranged at terminal end 144 of shaft 140 to retrieve ferrous objects 104. Magnet 180 may further comprise rubberized stop 184 for preventing unwanted displacement of walking cane 110 while in in-use condition 108 for steadying user 190.

Walking stick with a trigger mechanism system 100 may be sold as a kit (not shown) comprising the following parts: plurality of walking stick with a trigger mechanism assemblies 102 in various colors, designs, logos, indicias, and shaft lengths to accommodate users 190 of varying heights; and a set of user-instructions. The kit has instructions such that functional relationships are detailed in relation to the structure of the invention (such that the invention can be used, maintained, or the like in a preferred manner). Walking stick with a trigger mechanism 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different mechanical activating means for the grabber or combinations thereof, parts may be sold separately, etc., may be sufficient.

Figure 5:
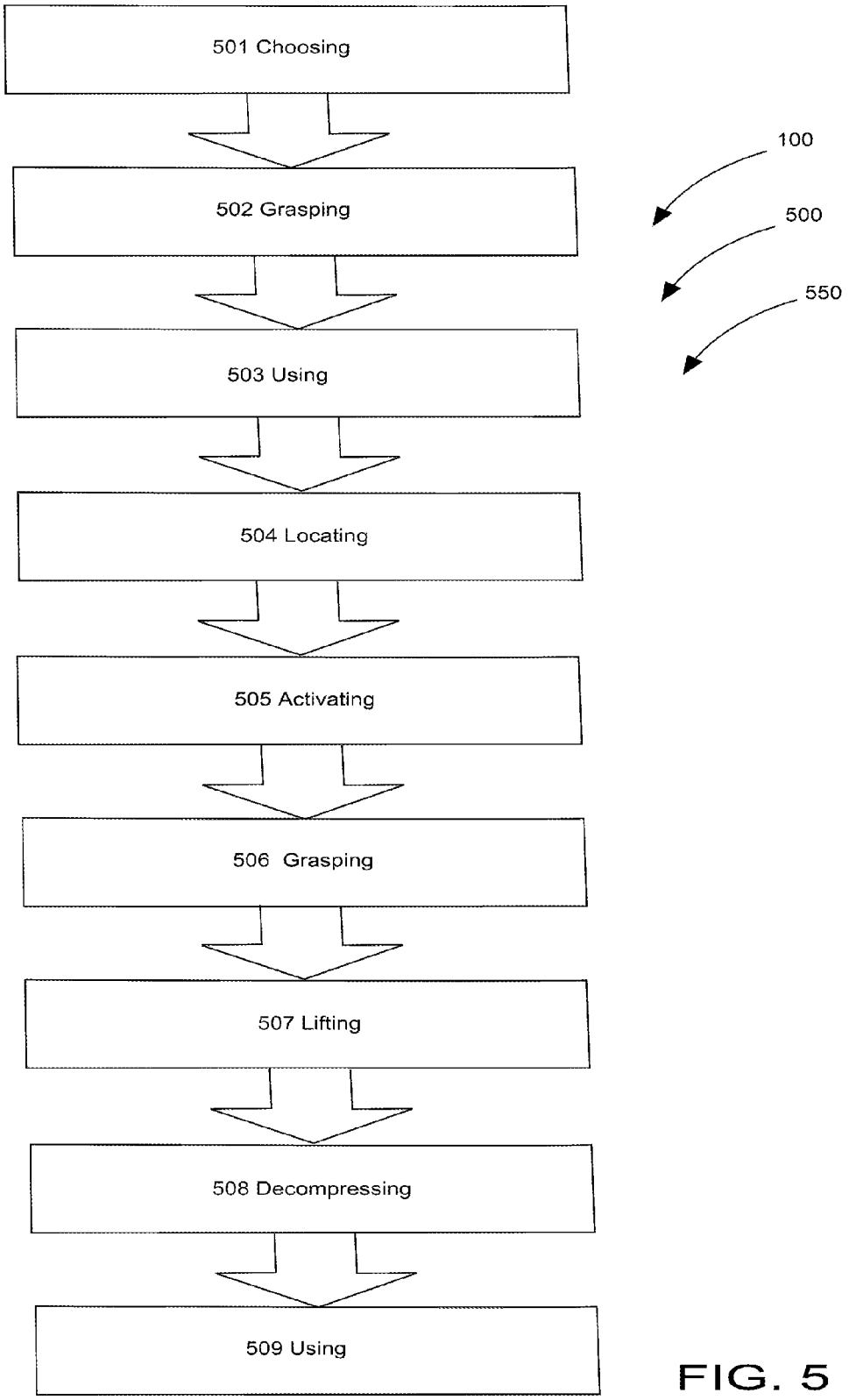
FIG. 5 is a flowchart illustrating a method of use for the walking stick with a trigger mechanism system according to an embodiment of the present invention of FIGS. 1-4B.

Referring now to FIG. 5, flowchart 550 illustrating method of use 500 for walking stick with a trigger mechanism system 100 according to an embodiment of the present invention of FIGS. 1-4B.

Method of using walking stick with a trigger mechanism system 100 comprises the steps of: step one 501 choosing walking stick with a trigger mechanism assembly 102 in a user-preferred shaft-length 140, color, and design; step two 502 user 190 grasping handle 120 of walking stick with a trigger mechanism assembly 102; step three 503 user 190 using walking stick 110 to aid in walking; step four 504 user 190 locating at least one item 104 on planar surface 106 to be picked up; step five 505 user 190 activating grabber 150 to open position 158 by squeezing trigger mechanism 130 on handle 120 to grasp at least one item 104; step six 506 grabber 150 grasping at least one item 104; step seven 507 user 190 lifting walking cane 110 to access at least one item 104; step eight 508 user 190 decompressing trigger mechanism 130 to release at least one item 104 thereby moving grabber 150 to closed position 400; and step nine 509 user 190 using walking stick with a trigger mechanism assembly 102 as walking cane 110 once again until a final destination is reached.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A walking stick with a trigger mechanism system comprising:

a walking stick with a trigger mechanism assembly,
- said walking stick having a handle including said trigger mechanism assembly;
- a shaft having a length and including:
  - a grabber having an upper end and a lower end, the upper end being pivotally attached to the shaft;
    - wherein the grabber is able to be manipulated between open and closed positions;
    - wherein in the open position, the grabber is pivoted away from the shaft;
    - wherein in the closed position, the grabber is positioned parallel to the shaft;
    - wherein the grabber is normally in the closed position;
  - a grabber manipulator; and
  - a magnet;

wherein said walking stick with a trigger mechanism assembly comprises heavy-duty plastic to provide durability, strength, and corrosion-resistance;

wherein said handle provides a region for a hand of a user to grasp said walking stick;

wherein said handle has a hollow interior;

wherein said trigger mechanism assembly comprises a trigger mechanism comprising a lever with a plurality of indented-contours adapted to match alignment with said user's hand, said indented-contours comprising digit-engageable notches adapted for wrapping at least one of said user's fingers around said trigger mechanism prior to activating said trigger mechanism;

wherein the trigger mechanism is squeezable between an activated position wherein said trigger mechanism is squeezed and moves toward said handle and a released position wherein said trigger mechanism is decompressed and moves away from said handle;

wherein the grabber manipulator comprises a cable, said cable attached at one end to the trigger mechanism and at an opposite end to the grabber;

wherein said trigger mechanism assembly is activated by manipulating said trigger mechanism toward said handle, thereby pulling on said grabber manipulator;

wherein when said trigger mechanism is squeezed, said grabber is moved in an outward direction away from said shaft into said open position ready for an in-use condition suitable for picking up at least one item from a surface;

wherein when said trigger mechanism is in the activated position, said grabber is in said open position;

wherein when said trigger mechanism is decompressed, said grabber moves in an inward direction towards said shaft into said closed position;

wherein when said trigger mechanism is in the released position, said grabber is in said closed position;

wherein said grabber lower end comprises a plurality of indents for removably-securing said at least one item when grabbed, said plurality of indents comprising teeth;

wherein said magnet is structured and arranged at a terminal end of said shaft to retrieve ferrous objects;

wherein said magnet further comprises a rubberized stop for preventing unwanted displacement of said walking cane while used for steadying said user; and wherein said walking stick with a trigger mechanism system is structured and arranged to permit said user to retrieve said at least one item from said surface without unduly bending and stretching.

* * * * *